US008505350B2

(12) United States Patent
Marshall et al.

(10) Patent No.: US 8,505,350 B2
(45) Date of Patent: Aug. 13, 2013

(54) APPARATUS FOR THREADING CANS

(75) Inventors: Harold James Marshall, Forest, VA (US); Jeffrey L. Shortridge, Lynchburg, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 24 days.

(21) Appl. No.: 13/024,830

(22) Filed: Feb. 10, 2011

(65) Prior Publication Data

US 2011/0164948 A1 Jul. 7, 2011

Related U.S. Application Data

(62) Division of application No. 11/692,564, filed on Mar. 28, 2007, now Pat. No. 7,905,130.

(60) Provisional application No. 60/787,502, filed on Mar. 31, 2006.

(51) Int. Cl.

| | |
|---|---|
| ***B21H 3/04*** | (2006.01) |
| ***B21H 3/02*** | (2006.01) |
| ***B21J 9/18*** | (2006.01) |

(52) U.S. Cl.
USPC ..... 72/104; 72/103; 72/121; 72/452.1

(58) Field of Classification Search
USPC ..... 72/94, 103, 104, 105, 106, 120, 121, 72/126, 715; 413/23
See application file for complete search history.

(56) References Cited

U.S. PATENT DOCUMENTS

| | | | |
|---|---|---|---|
| 1,621,301 | A | 1/1927 | Wright |
| 2,346,376 | A | 8/1942 | Heavener |
| 2,686,551 | A | 8/1954 | Laxo |
| 2,928,454 | A | 3/1960 | Laxo |
| 3,096,709 | A | 7/1963 | Eldred |
| 3,621,530 | A | 11/1971 | Pflieger |
| 3,983,729 | A | 10/1976 | Traczyk et al. |

(Continued)

FOREIGN PATENT DOCUMENTS

| | | |
|---|---|---|
| CA | 2536841 | 3/2005 |
| CA | 2536841 A1 | 3/2005 |

(Continued)

OTHER PUBLICATIONS

Applicants inform the PTO that an offer for sale was made more than one year before the date of this application of a device represented by the attached Figure ("Exhibit A"). Additional information is available upon request. Before Mar. 2006; Author: Belvac Production Machinery, Inc.

(Continued)

*Primary Examiner* — Teresa M Ekiert
(74) *Attorney, Agent, or Firm* — Nixon Peabody LLP

(57) ABSTRACT

A threading turret assembly includes a plurality of threading heads. The threading heads comprise first and second threading rollers. The threading head is configured to impart a thread onto a metallic can such that a threaded cap may be screwed onto the can to seal an opening in the can. The turret assembly is configured to rotate such that the plurality of threading heads orbit the centerline of rotation about which the turret rotates. The turret is configured to impart a rotation onto the plurality of threading heads as the threading heads orbit the center of rotation.

12 Claims, 12 Drawing Sheets

(56) References Cited

U.S. PATENT DOCUMENTS

| | | | | |
|---|---|---|---|---|
| 4,030,432 | A | | 6/1977 | Miller et al. |
| 4,102,168 | A | | 7/1978 | Brookes et al. |
| 4,207,761 | A | | 6/1980 | Niemi |
| 4,513,595 | A | | 4/1985 | Cvacho |
| 4,697,691 | A | | 10/1987 | Zodrow et al. |
| 4,892,184 | A | | 1/1990 | Vander Griendt et al. |
| 5,293,765 | A | * | 3/1994 | Nussbaum-Pogacnik ..... 72/103 |
| 5,704,240 | A | | 1/1998 | Jordan |
| 5,762,174 | A | | 6/1998 | Risley et al. |
| 6,050,396 | A | | 4/2000 | Moore |
| 6,055,836 | A | | 5/2000 | Waterworth et al. |
| 6,176,006 | B1 | | 1/2001 | Milliman et al. |
| 6,199,420 | B1 | | 3/2001 | Bartosch |
| 6,233,993 | B1 | | 5/2001 | Irie |
| 6,378,695 | B1 | | 4/2002 | Rinne |
| 6,467,322 | B2 | | 10/2002 | Nogami et al. |
| 6,644,083 | B2 | | 11/2003 | Pakker |
| 6,672,122 | B2 | | 1/2004 | Mustread et al. |
| 6,779,651 | B1 | | 8/2004 | Linglet et al. |
| 7,464,573 | B2 | | 12/2008 | Shortridge |
| 7,530,445 | B2 | | 5/2009 | Marshall et al. |
| 2005/0193796 | A1 | | 9/2005 | Heiberger et al. |
| 2007/0017089 | A1 | | 1/2007 | Hosoi |
| 2007/0227218 | A1 | | 10/2007 | Shortridge |
| 2007/0227320 | A1 | | 10/2007 | Marshall |
| 2007/0227859 | A1 | | 10/2007 | Marshall et al. |
| 2007/0249424 | A1 | | 10/2007 | Marshall et al. |
| 2007/0251803 | A1 | | 11/2007 | Schill et al. |
| 2008/0282758 | A1 | | 11/2008 | Shortridge et al. |

FOREIGN PATENT DOCUMENTS

| | | | |
|---|---|---|---|
| DE | 19 39 623 | | 8/1969 |
| DE | 101 56 085 | | 5/2003 |
| FR | 2881123 | | 7/2006 |
| GB | 0 730 6 | | 0/1898 |
| JP | 10-128474 | A | 5/1998 |
| JP | 10-263732 | A | 5/1998 |
| JP | 2002-102968 | | 4/2002 |
| JP | 2002-066674 | A | 5/2002 |
| JP | 2004-130386 | | 4/2003 |
| JP | 2003-237752 | | 8/2003 |
| JP | 2003-251424 | | 9/2003 |
| JP | 2003-252321 | | 9/2003 |
| JP | 2003-320432 | | 11/2003 |
| JP | 2004-002557 | | 1/2004 |
| JP | 2004-160468 | | 6/2004 |
| JP | 2004-217305 | | 8/2004 |
| JP | 2005-022663 | | 1/2005 |
| JP | 2006-176140 | | 7/2006 |
| JP | 2006-176183 | | 7/2006 |
| WO | WO-94/12412 | | 6/1994 |
| WO | WO-96/33032 | | 10/1996 |
| WO | WO-97/37786 | | 10/1997 |
| WO | WO-97-49509 | | 12/1997 |
| WO | WO-2005/023450 | | 3/2005 |
| WO | WO-2006/067901 | | 6/2006 |
| WO | WO-2006/095215 | A1 | 9/2006 |

OTHER PUBLICATIONS

European Office Action for European Application No. 07754363.5 dated Jan. 8, 2010.
European Office Action for European Application No. 07754475.7 dated Jan. 29, 2010.
Notice of Allowance dated Apr. 13, 2009 in U.S. Appl. No. 11/643,950.
PCT International Search Report on International Application No. PCT/JP2007/007958 mailed Oct. 11, 2007; 4 pages.
PCT International Search Report on International Application No. PCT/US2007/007831 mailed Sep. 19, 2007; 2 pages.
PCT International Search Report on International Application No. PCT/US2007/007832 mailed Sep. 27, 2007; 3 pages.
PCT International Search Report on International Application No. PCT/US2007/007957 mailed Sep. 19, 2007; 2 pages.
PCT International Search Report on International Application No. PCT/US2007/007959 mailed Sep. 5, 2007; 2 pages.
PCT International Search Report on International Application No. PCT/US2007/007960 mailed Sep. 6, 2007; 2 pages.
USPTO final office action on U.S. Appl. No. 11/581,787 mailed Dec. 29, 2009; 12 pages.
USPTO Final Office Action on U.S. Appl. No. 11/643,935 mailed Mar. 2, 2010; 10 pages.
USPTO Final Office Action on U.S. Appl. No. 11/692,564 mailed Jul. 1, 2009; 7 pages.
USPTO non-final office action on U.S. Appl. No. 11/581,787 mailed Jun. 17, 2009; 12 pages.
USPTO Non-final Office Action on U.S. Appl. No. 11/643,934 mailed Mar. 17, 2008; 14 pages.
USPTO Non-final Office Action on U.S. Appl. No. 11/643,935 mailed Aug. 28, 2009; 14 pages.
USPTO Non-final Office Action on U.S. Appl. No. 11/643,950 mailed Aug. 11, 2008; 10 pages.
USPTO Non-final office action on U.S. Appl. No. 11/692,564 mailed Dec. 23, 2009; 9 pages.
USPTO Non-final Office Action on U.S. Appl. No. 11/692,564 mailed Dec. 31, 2008; 15 pages.
USPTO Non-final Office Action on U.S. Appl. No. 11/692,564 mailed Jun. 21, 2010; 9 pages.
USPTO Non-final Office Action on U.S. Appl. No. 11/692,584 mailed Mar. 10, 2010; 26 pages.
USPTO Non-final Office Action on U.S. Appl. No. 12/656,099 mailed Jun. 11, 2010; 14 pages.
USPTO Notice of Allowance and Fees Due on U.S. Appl. No. 11/643,950 mailed Dec. 4, 2008; 4 pages.
USPTO Notice of Allowance and Fees Due on U.S. Appl. No. 11/692,584 mailed Jun. 25, 2010; 10 pages.
USPTO Notice of Allowance on U.S. Appl. No. 11/692,564 dated Nov. 5, 2010; 13 pages.
USPTO Notice of Allowance on U.S. Appl. No. 11/692,584 mailed Sep. 20, 2010; 7 pages.
USPTO Notice of Allowance on U.S. Appl. No. 12/656,099 dated Dec. 3, 2010; 8 pages.
USPTO Notice of Allowance on U.S. Appl. No. 11/581,787 mailed Apr. 19, 2010; 4 pages.
USPTO Notice of Allowance on U.S. Appl. No. 11/581,787 mailed Jun. 23, 2010; 4 pages.
USPTO Notice of Allowance on U.S. Appl. No. 11/643,934 mailed Sep. 24, 2008; 6 pages.
USPTO Office Action on U.S. Appl. No. 11/643,935 mailed Aug. 31, 2010; 9 pages.
USPTO Supplemental Notice of Allowability on U.S. Appl. No. 11/692,584 mailed Nov. 17, 2010; 3 pages.
European Patent Office extended search report on application 11191432.1 dated Mar. 15, 2012; 6 pages.
European Search Report and Written Opinion on application No. 11178610.9 dated Dec. 30, 2011; 6 pages.
European search report on application No. 10174693.1 dated May 11, 2011; 3 pages.
USPTO Notice of Allowance and Fee Due on U.S. Appl. No. 11/643,935 dated Feb. 16, 2011; 7 pages.
USPTO Notice of Allowance and Fee Due on U.S. Appl. No. 12/892,458 dated Mar. 8, 2011; 12 pages.

* cited by examiner

APPARATUS FOR THREADING CANS

CROSS-REFERENCE TO RELATED PATENT APPLICATIONS

This application is a divisional application of U.S. application Ser. No. 11/692,564, filed Mar. 28, 2007, which claims the benefit under 35 U.S.C. §119(e) of U.S. Provisional Application No. 60/787,502, filed Mar. 31, 2006, both of which are incorporated herein by reference in their entirety.

BACKGROUND

The present invention relates generally to the field of forming or processing an article, such as a beverage container or can. More specifically, the invention relates to an apparatus and method for forming a thread on an article.

Conventional machines for forming a thread have required multiple forming heads and forming turrets. Such conventional apparatus can require significant floor and machine line space. Other conventional threading apparatus require separate machines which may not integrate easily with a machine line, thus slowing down the overall processing time of an article.

It is an object of the invention to have an apparatus that can form a thread on an article, such as a beverage container or can in a machine line, that minimizes space and processing time requirement

SUMMARY

One embodiment of the invention relates to a threader head. The threader head comprises a first threading roller with a threaded surface and a second threading roller with a threaded surface. The threading head is configured to impart a thread onto a cylindrical container such that a threaded cap may be screwed onto the container to seal an opening in the container.

Another embodiment of the invention relates to a threading head assembly. The threading head assembly comprises a threader head and a container holder. The threader head includes first and second threading rollers. The threading head is configured to impart a thread onto a container such that a threaded cap may be screwed onto the container to seal an opening in the container. The container holder is configured to apply a gripping force to grip the container and configured to remove the gripping force to release the container.

Another embodiment of the invention provides a threading turret assembly. The threading turret assembly comprises a threading head and a ram. The threading head includes first and second threader rollers. The threading head is configured to impart a thread onto a container such that a threaded cap may be screwed onto the container to seal an opening in the container. The ram is configured to drive the container to be threaded towards the threader head such that one of the two threading rollers is positioned inside an opening in the container. The ram is configured to move the container away from the threading head after the container has been threaded.

Yet another embodiment of the invention provides a method of preparing a stress induced plastically deformed container for use as a threaded sealable container. The method comprises at least one of (i) automatically placing a curved wall of a plastically deformable container in between two threading rollers, and (ii) automatically placing the two threading rollers on either side of the curved wall, causing the two threading rollers to contact opposite sides of the curved wall, and automatically orbiting the threading rollers about the container to impart a helical thread onto the curved wall.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

FIG. 3(*b*) illustrates a front plan view of the first threading roller; and FIG. 3(*c*) illustrates a section of the first threading roller taken along line A-A of FIG. 3(*b*).

FIG. 4(*b*) illustrates a front plan view of the second threading roller; and FIG. 4(*c*) illustrates a section of the second threading roller taken along line B-B of FIG. 4(*b*).

FIG. 12(*h*) is a detail perspective view of a push ram assembly of the threading turret; and FIG. 12(*e*) is a detail view of a plush plate assembly of the threading turret.

DETAILED DESCRIPTION

Figure 1:
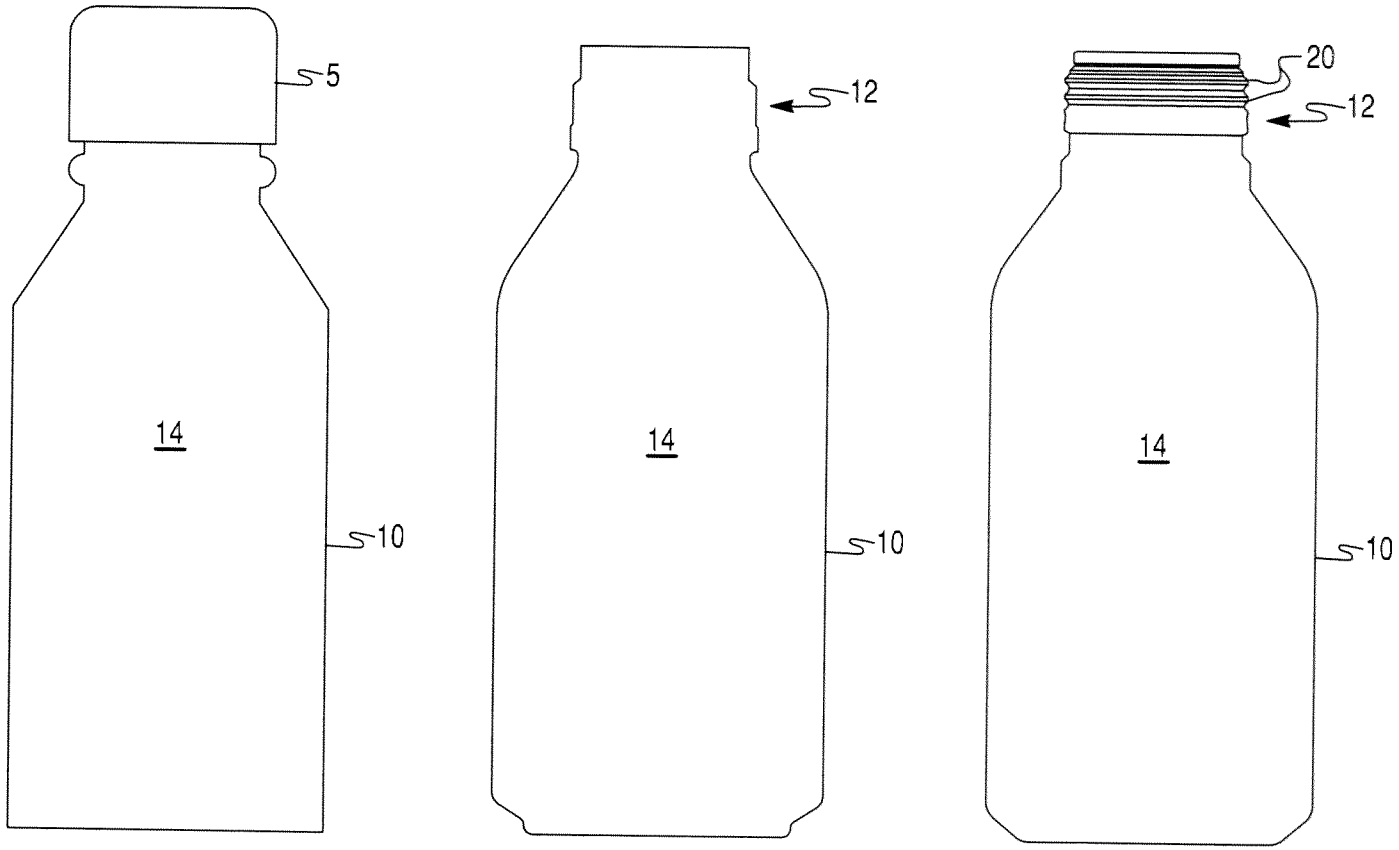
FIG. 1 illustrates a plurality of cans prior to and after a threading operation.

In an embodiment of the present invention, there is a device configured to create threads on an open end of a container, such that a threaded cap may be screwed onto the open end of the container to seal an opening in the container. In some embodiments, the container is a metal (aluminum, tin, etc.) can, and in other embodiments the container is made of a stress-induced plastically deformable material. Other embodiments include methods and systems for utilizing such device(s).

FIGS. 1-13 illustrate an apparatus for forming a thread 20 on an article 10. An article 10 may be a can, any suitable food or beverage container, jar, bottle or any other suitable article. The article 10 has a neck 12 with an open end, an opposite closed end, and a sidewall 14 extending from the closed end.

Alternatively, the article 10 may be open at both ends. Threads 20 are formed on the neck 12 of the article 10. A cap 5, top, lid or other closure may be added to the article 10 after the threading process.

For exemplary purposes only, the below description will describe the threading apparatus and method for use on a can 10. It will be recognized that any other type of article 10 (such as that described above) may be used.

Threading describes a process by which raised helical ribs 20 are formed on the neck 12 of a can 10. FIG. 1 depicts a group of metal cans 10 in different stages of a threading operation. In FIG. 1, an embryonic metal can 10 (center) is depicted prior to the impartment of threads 20 onto the can 20. FIG. 1 also depicts a threaded metal can 10 (far right) after the impartment of threads 20 onto the can 10 utilizing a device (a threading head) 50 according to an embodiment.

Figure 2:
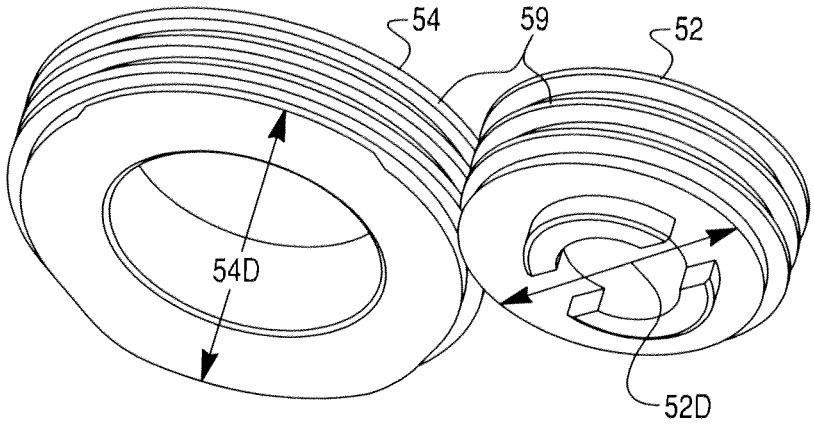
FIG. 2 is a top perspective view of a pair of meshing threading rollers according to an embodiment.
Figure 5:
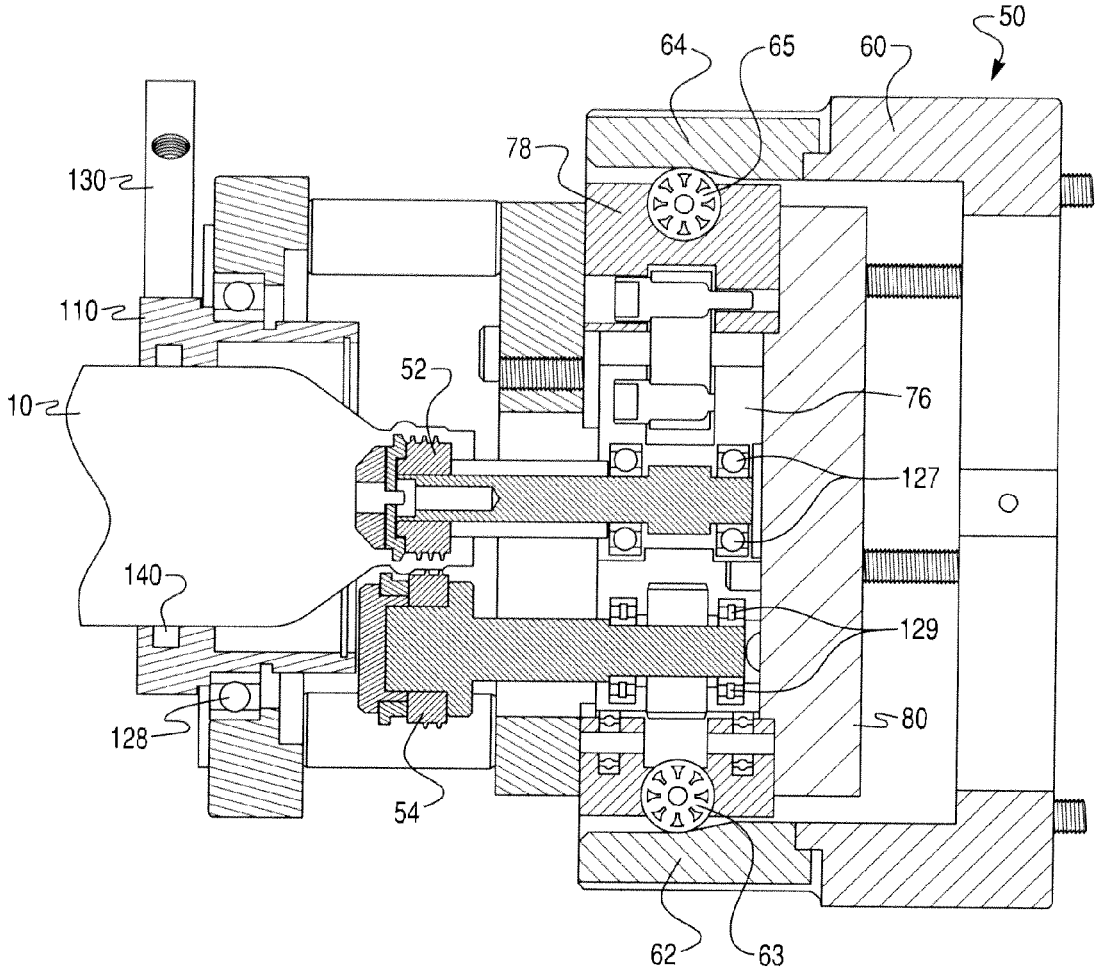
FIG. 5 is a side view of a threading head according to an embodiment of the invention.
Figure 6:
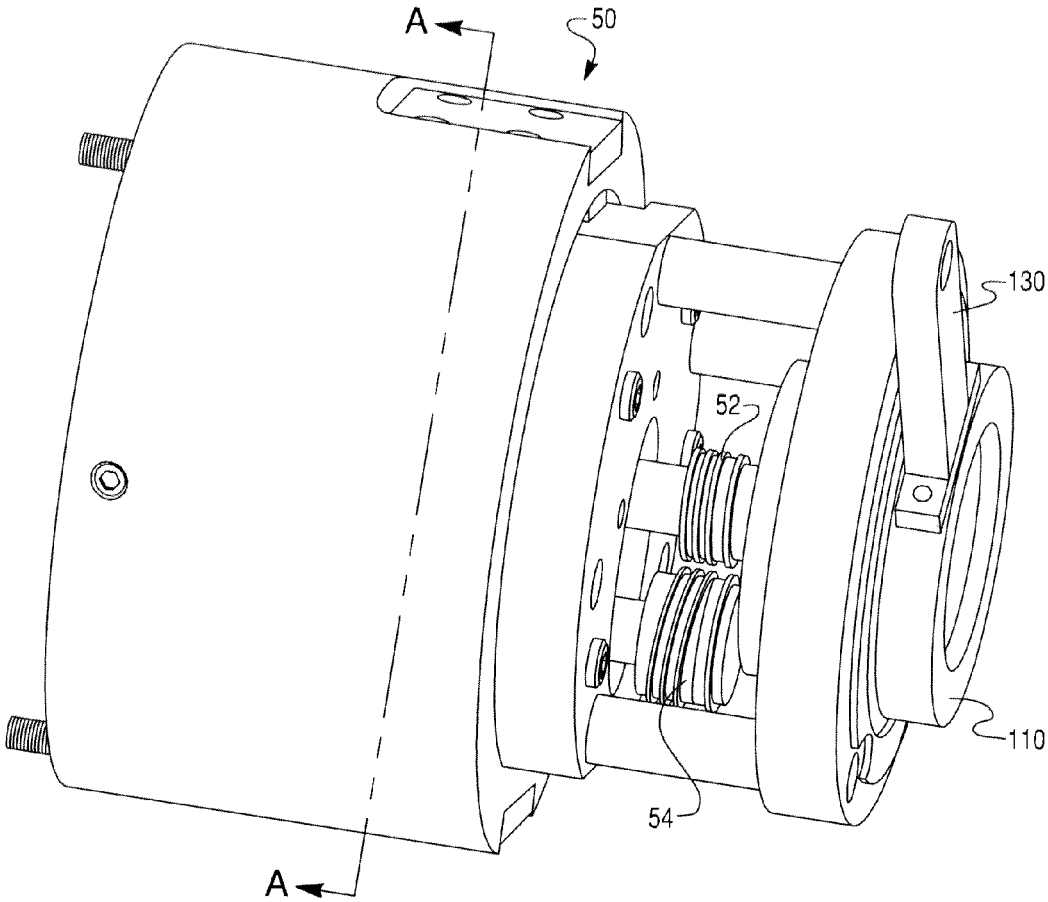
FIG. 6 is a perspective view of the threading head of FIG. 5.

FIGS. 2 and 5 depict an exemplary embodiment of a threading head 50 according to a threading embodiment, including threading rollers 52 and 54. In some embodiments, roller 52 has a smaller outer diameter 52D than an outer diameter 54D of roller 54. Threading roller 52 is placed inside the open end of the container 10, and roller 54 is placed outside the open end of the container 10. In some embodiments of the invention, the threads 59 of the threading rollers 52, 54 mesh, with, of course, the material of the can 10 interposed in between, as may be seen in FIG. 5.

In some threading embodiments, the threading rollers 52, 54 are mounted on a threading head 50 as depicted in FIG. 5.

A brief discussion of how some embodiments of the threading head 50 operates will now be provided. In some embodiments, an embryonic (i.e., a can without threads 20) can 10 is transferred into a threading turret 100 (shown in FIG. 9) and moved into alignment with the threading head 50. The can 10 is moved so that the threading roller 52 is positioned inside the openings of the can 10 and roller 54 is positioned outside the opening of the can 10, as may be seen in FIG. 5. However, in other embodiments, the threading head 50 may be lowered down onto the can 10, and/or both may be moved into position. The threading turret 100 may be an independent module or part of a machine line 200, such as shown in FIG. 14.

In some threading embodiments, the threading head 50 actuates to close the threading rollers 52 and 54 onto the periphery of the open end of the can 10. In some embodiments of the present invention, both threading rollers 52 and 54 are moved towards each other to close on the periphery on the open end of the can 10. For example, when viewed from FIG. 5, the threading rollers 52 and 54 move in a longitudinal direction (y-plane along the length of the page) toward each other or away from each other. Alternatively, the threading rollers 52 and 54 move in two directions, such as in the y-plane and in the z-plane (into the page). Alternatively, the can 10 is moved towards the threading roller 52 so that the threading roller 52 is positioned inside the can 10. The threading roller 52 inside the can is stationary with respect to the can 10 while the threading roller 54 is moved towards the threading roller 52, and the can 10. In other embodiments of the present invention, the threading roller 52 moves towards the threading roller 54 while the threading roller 54 is stationary, and the can 10 is moved towards threading roller 54. A threading roller 52, 54 is "stationary" with respect to the can 10. A "stationary" threading roller 52 or 54 rotates about its axes during the threading operation, but does not move in the x-, y-, or z-direction with respect to the can 10. The threading operation will be described below.

When the threading rollers 52 and/or 54 are actuated (or otherwise moved) to close on the periphery of the neck 12 of the can 10, the threads 20 are then formed on the can 10. The thread 20 is formed by rotating the threading head 50 with respect to the can 10, which is rotationally stationary with respect to the threading head 50. The threading head 50 moves one or both of the threading rollers 52, 54 to contact a sidewall 14 of a neck 12 of a can 10 such that the sidewall 14 is between the respective threads surfaces of the threading rollers 52, 54. The threading rollers 52, 54 impart a sufficient pressure to plastically deform the sidewall 14 of the can 10 to impart a thread 20. The necessary pressure is determined by the type, material, shape, etc. of the can 10, among other possible things.

In other embodiments of the invention, the can 10 is rotated with respect to the threading head 50. In yet other embodiments of the present invention, both the can 10 and the threading head 50 are rotated with respect to each other. Any rotation of either the can 10 and/or the threading head 50 may be utilized to practice the invention providing that the threading rollers 52, 54 may sufficiently impart threads 20 on the can 10. In other embodiments of the present invention, rotation of the threading rollers 52, 54 simply results from the rotation of the threading head 50 itself with respect to the can 10, such that friction between the can 10 and the threading rollers 52, 54 results in rotation of the threads 59. In yet other embodiments of the present invention, both the can 10 and the threading rollers 52, 54 are rotated. In yet other embodiments, both the threading rollers 52, 54 and the threading head 50 are rotated.

Figure 3A:
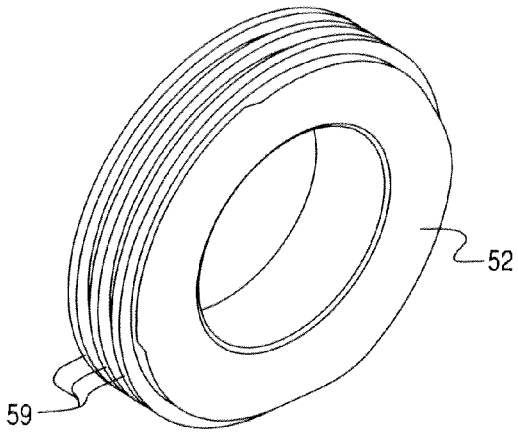
FIGS. 3(*a*) to 3(*c*) illustrate a first threading roller in which FIG. 3(*a*) illustrates a perspective view of the first threading roller.
Figure 3C:
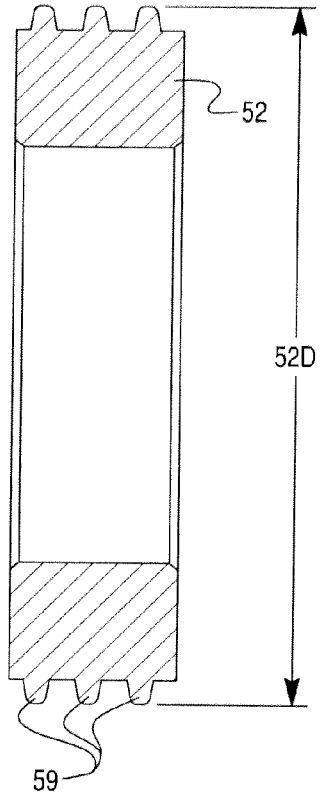
Figure 3B:
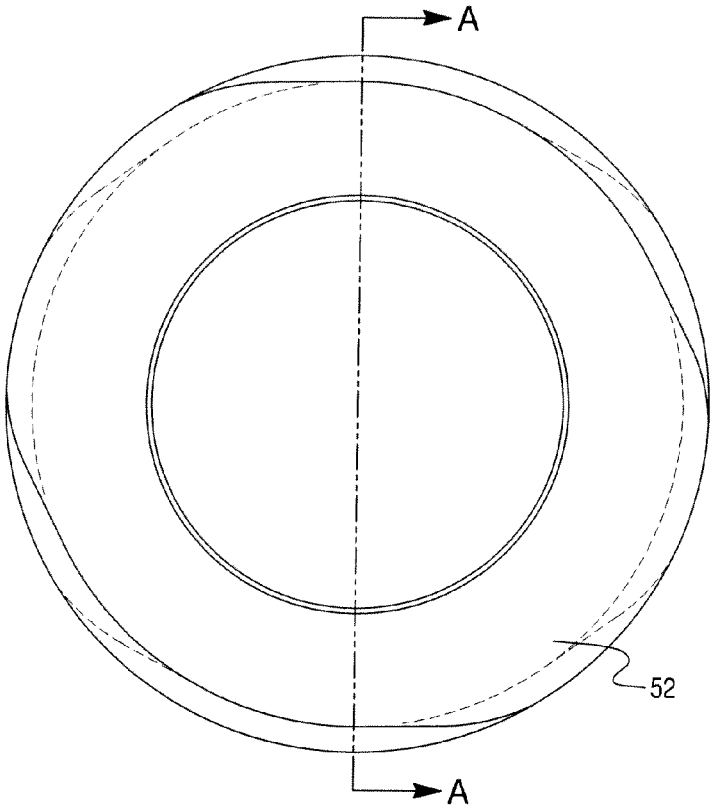
Figure 4A:
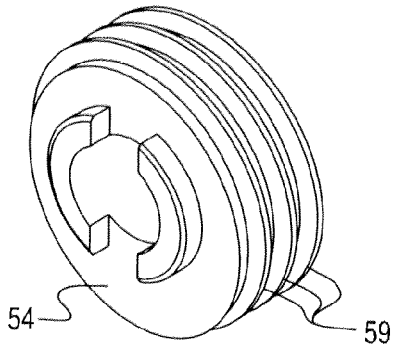
FIGS. 4(*a*) to 4(*c*) illustrate a second threading roller to mesh with the first threading roller in which FIG. 4(*a*) illustrates a perspective view of the second threading roller.
Figure 4C:
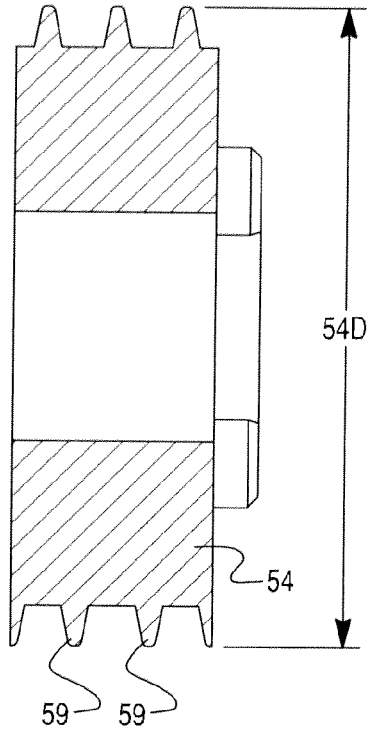
Figure 4B:
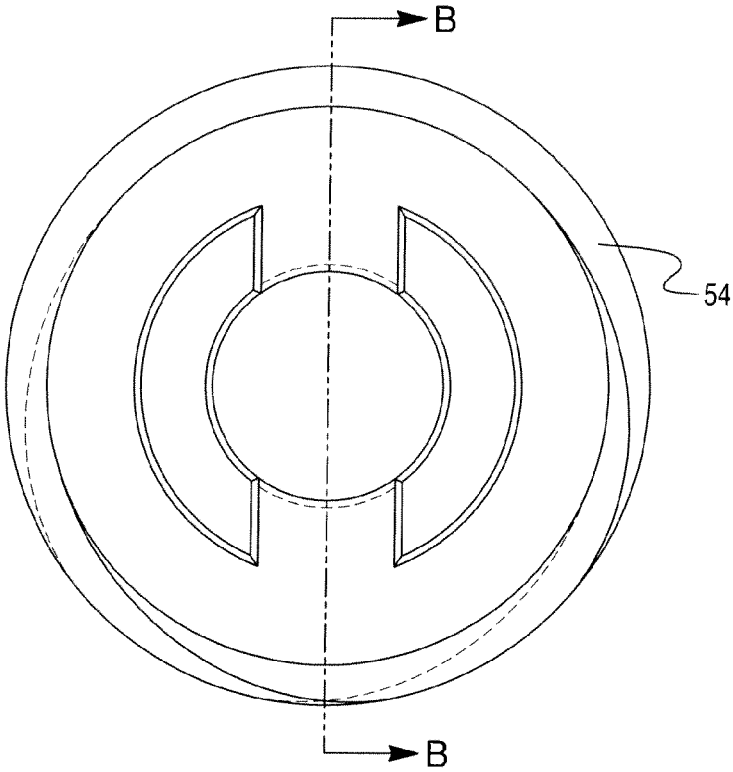

As may be seen generally in some of the figures, for example, FIGS. 2-4, the threading rollers 52 and 54 have threads 59 about their outer diameters 52D, 54D. The threads 59 of the threading rollers 52, 54 mesh with each other as would be understood in the art, to form the threads 20 on the neck 12 of the can 10.

In one embodiment the threading roller 54 may have a double pitch thread 59, while the threading roller 52 may have a single pitch thread 59. However, in other embodiments, threading roller 54 could have quadruple pitch thread 59 while the threading roller 52 could have a double pitch thread 59, etc. Any thread number, pitch, and/or size may be used in some embodiments of the invention as long as the threading rollers 52, 54 will impart sufficient threading 20 onto a can 10.

When the threading operation is completed for a can 10, the threading rollers 52, 54 (one or both) are actuated to open and may be extracted from the periphery open end of the now-threaded can 10. The threading head 50 and/or the can 10 is then moved away so that the can 10 may be sent down the machine (sometimes referred to as a "production") line 200.

The following describes some embodiments of the operation of the threading head 50 in general and the inner workings of the threading head 50, in particular.

First, actuation of the threading roller 52 and/or 54 towards and away from each other will be described. Referring to FIGS. 5-8, and any other applicable figures, the cylindrical body 60 of the threading head 50 includes an outer threading roll cam 62 and a inner threading roll cam 64 which are separate components mated to the cylinder 60. However, in other embodiments of the present invention the threading roll cams 62, 64 may be an integral portion of the cylinder 60, being, for example, machined therein. In some embodiments of the invention, elements 62 and 64 are identical. Any cam surface that may be utilized to practice embodiments of the present invention may be utilized herein.

Referring to FIGS. 5-8, there is a threading head platform 80 on which the threading rollers 52, 54 and the associated components (discussed in greater detail below) are mounted. On the platform 80, threading roller pinion shaft support components 76 and 78 are located. These support components 76, 78 are respectively linked to rollers 63 and 65, which interface with their respective cams 62 and 64. The support assemblies 76, 78 are spring loaded by a spring 74 such that as the cylinder 60 moves relative to the platform 80 in the axial direction, and the rollers 63 and 65 move along the surface of the cams 62, 64. As the rollers 63, 65 move from the cam sections 62, 64 having a smaller diameter to a larger diameter, the support assemblies 76 and 78, supporting the respective threading geared roll pinion shafts 66, 68 are moved outward. That is, the spring force may be relaxed somewhat due to the rollers 63 and 65 traveling into a portion of the cylinder 60 where there is more room such that the spring 74 may force the support assemblies 76, 78 outward, and thus force the rollers 63, 65 outward. When the support assembly 76, 78 is moved, the threading roll pinions 67, 68 are moved, and thus the threading rollers 52, 54 are moved.

In some embodiments of the invention, only one threading roller 52 or 54 is moved while in another embodiment, both threading rollers 52 and 54 are moved (away from each other and towards each other). In some embodiments, the outer threading roller 54 is moved outward and the inner threading roller 52 is moved inward when the cylinder 60 is moved upward with respect to the platform 80. That is, when the cylinder 60 is moved upward with respect to the platform 80, for example, in some embodiments, about seven- or eight-tenths of an inch, such that the threading rollers 52, 54 move from an area of the cylinder 60 of lesser cam area diameter to an area of greater cam diameter, the rollers 65 and 63 are pushed outward, thus pushing the threading rollers 52, 54 away from each other, and visa versa. (That is, when the cylinder 60 is moved downward, the threading rollers 52, 54 are moved towards each other.) Various mechanical structures may be implemented to achieve the just mentioned effects, and thus other embodiments may utilize different mechanical structures. Indeed, in some embodiments of the invention, solenoids may be used to move the rollers towards and away from each other, etc.

In some embodiments of the invention, threading roller pinion shaft support components 76 and 78 are arranged such that they pivot about the shafts 86, 88 that support pivot gears 82 and 84, thus, during movement of the threading rollers 52, 54 towards and away from each other, the threading rollers 52, 54 follow an arcuate path as opposed to a linear path. However, in other embodiments, the structure of the threading head 50 may be such that a linear path may be utilized. The movement of the threading rollers 52, 54 is about a tenth of an inch for each roller 52, 54 (that is, the outer roller 54 moves 1/10 of an inch in one direction, and the inner roller 52 moves about 1/10 of an inch in another direction), although the distance of travel could be more or less (especially more), in other embodiments.

Figure 7:
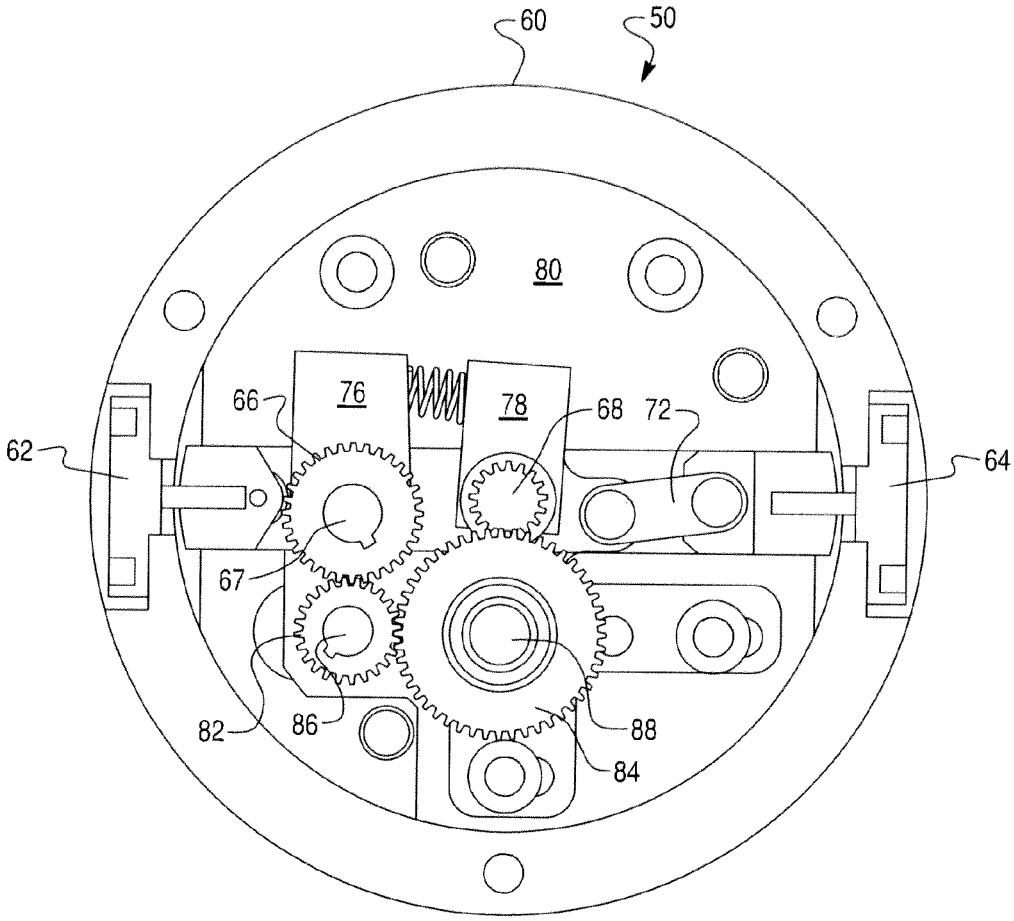
FIG. 7 is a front section view of the threading head taken along line A-A in FIG. 6.
Figure 8:
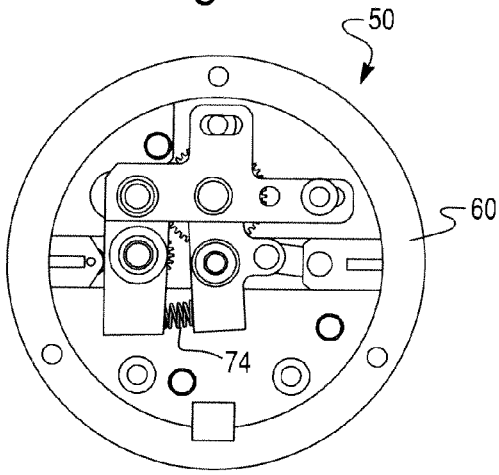
FIG. 8 is a rear view of the threading head of FIG. 5.

As can be seen in FIG. 7, the threader head 50 can also include a link 72 to connect the inner threading roll pinion shaft support component 78 with the inner thread roll cam 64. Furthermore, an outer thread roll gear 66 may be included and supported by the outer thread roll pinion shaft 67.

The following describes an exemplary embodiment of a threading embodiment relating to positioning the can 10 so that the can 10 may be threaded, and the static and dynamic relationship between the can 10, the threading head 50, and the threading turret 100, with respect to a center of rotation of the threading turret 100.

Cans 10 may be transferred into a threading turret 100 using the vacuum transfer star wheel method, by way of example. As will be explained in more detail below, the threading turrets 100 include multiple threading heads 50 that are each part of a threading station. Each threading station may include, in some embodiments, a push plate assembly 120 mounted to a sliding ram 124, and a star wheel 122. The sliding ram 124 moves the can 10 into a continuously rotating threading head 50. A push plate assembly 120 may include, in some embodiments, a plate with a profiled groove to match the base of the can 10 with a vacuum hole through the plate to allow suction on the base of the can 10. Any other push plate assembly 120 may be utilized.

Figure 11:
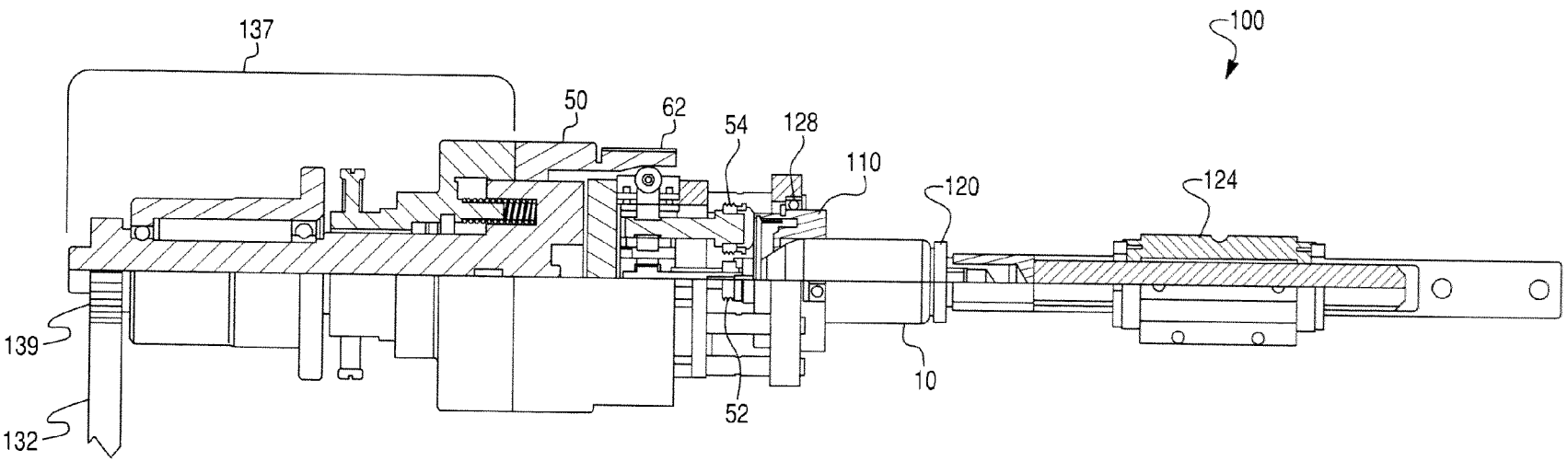
FIG. 11 is a sectional view of the threading turret taken along line C-C of FIG. 10.
Figure 12A:
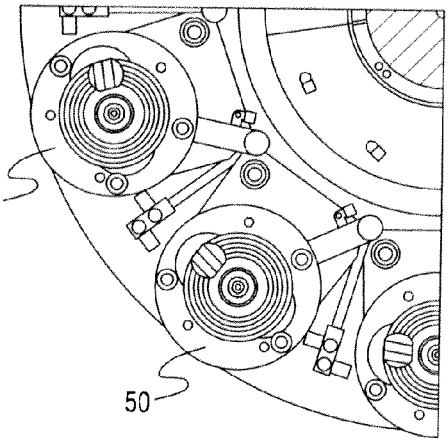
FIGS. 12(*a*) to 12(*c*) illustrate sections of the threading turret of FIG. 9, in which FIG. 12(*a*) illustrates a front detail view of a plurality of threading heads.
Figure 12B:
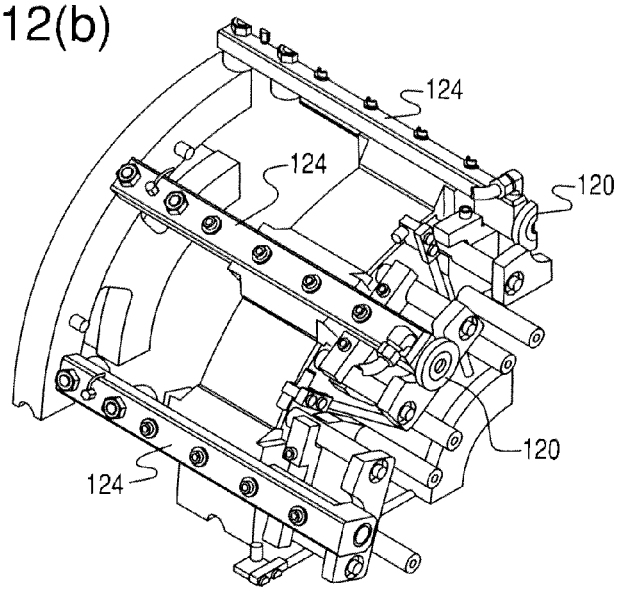
Figure 12C:
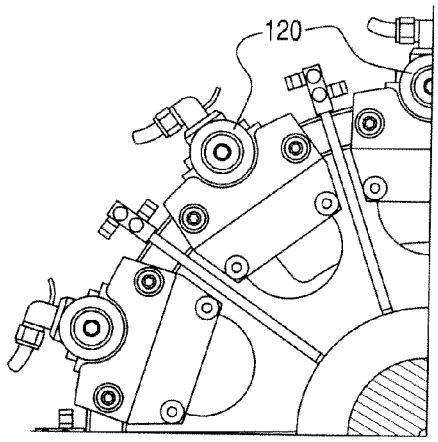

Referring to FIGS. 9-11 and 12(*a*)-12(*c*), there is an exemplary embodiment of a threading turret 100 including threading heads 50 as described above (although other threading turret designs may be utilized in the threading turret 100). The push plate assembly 120, according to the embodiments described above, operates with a vacuum to hold the can 10 to the push plate. The push plate assembly 120 pushes the can 10 into the threading head 50 and the can is aligned by the can holder assembly 110. FIG. 11 also illustrates a thread head drive spindle 137 and a spindle drive pinion gear 139 of the threading turret 100.

The turret 100 includes a can holder assembly 110, that, in some embodiments, is not rotating (as opposed to the threader turret 100), and is mounted on the front of the threading head 50 on bearings 128 to decouple rotation of the threader head 50, and includes a rotation arm 130 to prevent rotation of a can stop, as may be seen in FIGS. 5 and 11.

In an embodiment, the can holder assembly 110 includes an air bladder 140 (FIG. 5) that inflates with air to effectively grip the can 10 (i.e., the air expands the bladder 140 to grip the can 10 to hold the can 10 in place). The inflation air is passed through the rotation arm 130, shown in FIG. 5. The bladder 140 is inflated after the can 10 is pushed towards the threading head 50 such that the inner threading roller 52 is inside the opening at the desired depth (with respect to the longitudinal axis of the can 10) for threading. Thus, once the bladder 140 is inflated, the can 10 effectively will not move. That is, the can 10 is held stationary with respect to the particular threading head 50 and station.

As noted above, bearing 128 decouples rotation of the threader head 50 from the can holder 110. Thus, after the inflatable bladder 140 is inflated to grip the can 10, the rotation of the threader head 50 is still not imparted to the can 10. Regarding the can 10, in some threading embodiments, a face of the can 10 is always facing the axis of rotation of the threader turret assembly 100. That is, the revolution of the can 10 with respect to the axis of rotation of the threader turret 100 is akin to the revolution of the moon about the Earth—one side is always facing the axis of rotation of the threader turret 100 as the can 10 travels through the threader turret 100. Rotation arm 130 is rigidly connected to the turret 100 to prevent the can 10 from rotating in the threading head 50 station.

In another embodiment, the push plate 120 and can holder assembly 110 can act together to prevent the can 10 from rotating in the threading head 50 station. The push plate 120 can be coated with urethane rubber, or any other suitable substance. The spring loaded can holder assembly 110 preloads and prevents the can 10 from turning in the threading head 50 station. The can holder assembly 110 applies force on the can 10, but the can 10 does not move (rotate) because the can 10 is pushed against the push plate 120 with sufficient force and friction to prevent any movement of the can 10.

Regarding the dynamics of the threading heads 50, the threading heads 50 are orbiting about the axis of rotation of the threader turret 100. The threading heads 50 are rotating about their axis due to the spindle drive pinion gear 139 connected to the threader heads and a bull gear 132 about the axis of rotation of the threader turret 100, shown in FIG. 11.

As the threader heads 50 orbit about the bull gear 132, a rotation is imparted onto the threader heads 50 as a result of gear 139 meshing with the bull gear 132. In some embodiments, the bull gear 132 is stationary, although in other embodiments, the bull gear 132 could be driven to impart variable control onto the threader heads 50. In some embodiments, rotation of the bull gear 132 at varying speeds varies the rotation speed of the threading heads 50 accordingly. Further, in some embodiments of the present invention, movement of the threading heads 50 are akin to the Earth with respect to its movement about the sun and the rotation of the earth about its axis. Thus, the threading heads 50 are both rotating and revolving, but rotating in a manner such that the face of the threading head 50 is not constantly facing towards the axis of rotation of the threader turret 100. Because the cans 10 are held stationary within the threading station, and thus revolve in a manner the same as the threader heads 50, but rotate differently than the threader heads 50, there is relative rotation with respect to the cans 10 and the threader heads 50. It is noted in other embodiments of the present invention that the cans 10 may be held by the can holder 110 such that the can holder 110 moves to always position the face of the cans 10 in the same direction. Because there is relative rotation with respect to the cans 10 and the threader heads 50, there is relative rotation with respect to the cans 10 and the threading rollers 52, 54. That is, in some embodiments of the present invention, because the threader head 50 is rotating with respect to the cans 10 (basically, the cans 10 are not rotating with respect to the threader head 50), the outer threading roller 54 revolves (orbits) about the neck 12 of the can 10, and the inner threading roller 52 rotates inside the neck 12 of the can 10 (from the threader head 50 point of reference). The opening of the can 10 rotates between the inner and outer threading rollers 52, 54.

In some embodiments, prior to moving the threading rollers 52, 54 to contact the can 10, the inner threading roller 52 is approximately concentric with the opening of the can 10. In other embodiments, the inner threading roller 52 is not concentric. As long as there is clearance between the path of movement of the inner threading roller 52 and the can 10 prior to moving the threading rollers 52, 54 onto the can 10, such non-concentricity is acceptable. Of course, once the threading rollers 52, 54 are moved toward each other, the inner threading roller 52 becomes off-center, and the inner threading roller 52 is no longer concentric with the opening of the can 10.

As noted above, in some embodiments of the present invention, the threading rollers 52, 54 do not rotate on their own with respect to the threader head 50. That is, the threading rollers 52, 54 are not powered. However, once the threading rollers 52, 54 are actuated towards the can 10, and thus make contact on the can 10, friction forces between the can 10 and the threading rollers 52, 54 force the threading rollers 52, 54, which are mounted on bearings 127 and 129, as may be seen, for example, in FIG. 5, to begin to rotate (because, as noted above, the threading rollers 52, 54 are revolving about the can 10).

In some embodiments of the invention, when the threading rollers 52, 54 are rotating, the threader head 50 is configured such that there is a difference in the rotation speed of the threading rollers 52, 54. By way of example only, the threader head 50, in FIG. 7, may include gears 66, 68, 82, 84 that place the threading rollers 52, 54 in gear communication such that the ratio of revolution between the two threading rollers 52, 54 is two to one. That is, the gears 66, 68 maintain a ratio of 2:1 of the inner threading rollers 52 and the outer threading rollers 54. For example, gear 66 is twice is large (i.e., a diameter twice as big) as gear 68, thus forming a 2:1 ratio. The ratio is determined by gears 66 and 68. Gears 82, 84 are change or communication gears. The inner threading roller 52 thus rotates two times for every one time that the outer threading roller 54 rotates. Of course, in other embodiments of the invention, the ratio may be different. Any ratio that may be utilized to impart acceptable threads 20 onto a can 10 may be utilized to practice some embodiments of the invention.

As noted above, threading roller pinion shaft support components 76 and 78 (FIG. 7) are arranged such that they pivot about shafts 86, 88 supporting pivot gears 82 and 84, thus, during movement of the threading rollers 52, 54 towards and away from each other, the threading rollers 52, 54 follow an arcuate path as opposed to a linear path. It will be seen from, for example, FIG. 7, that the gears 66, 68, 82, 84 that maintain a rotation ratio between the two threading rollers 52, 54 can tolerate such arcuate paths due to their layout in the threader head 50 with respect to the pivot points.

Regarding the number of orbits about the can 10, after the threading rollers 52, 54 "pinch" down on the can 10, the threading rollers 52, 54 make about four orbits about the can 10 before being released, providing enough threads 20 of sufficient quality onto the can 10. In other embodiments, the number of orbits may be greater or less than four.

It is noted that while in the above described embodiment of the threading assembly, the threading rollers 52, 54 only rotate when they come into contact with the can 10, and then only due to the relative rotation of the threading head 50 with respect to the can 10 (and/or threading station). In other embodiments, the threading rollers 52, 54 may be powered such that they rotate without the need of relative rotation between the cans 10 and the threading head 50. Indeed, in other embodiments of the present invention, the cans 10 could be rotating and the threading heads 50 could be fixed with respect to the center of rotation of the threading turret 100. Basically, any rotation scheme that may be utilized to impart threads 20 onto a can 10 may be utilized to practice some embodiments of the present invention.

Figure 9:
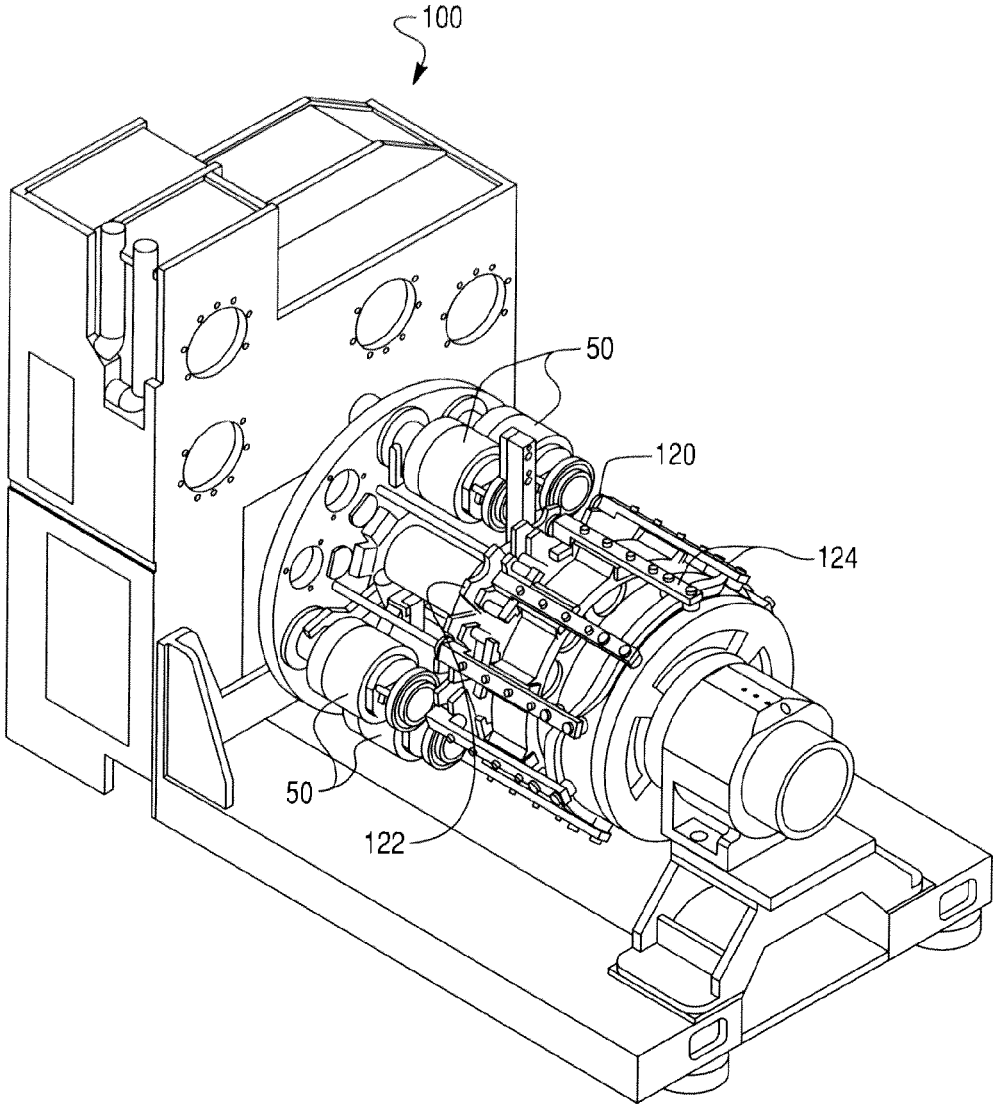
FIG. 9 is a perspective view of a threading turret with a plurality of threading heads according to an embodiment.
Figure 10:
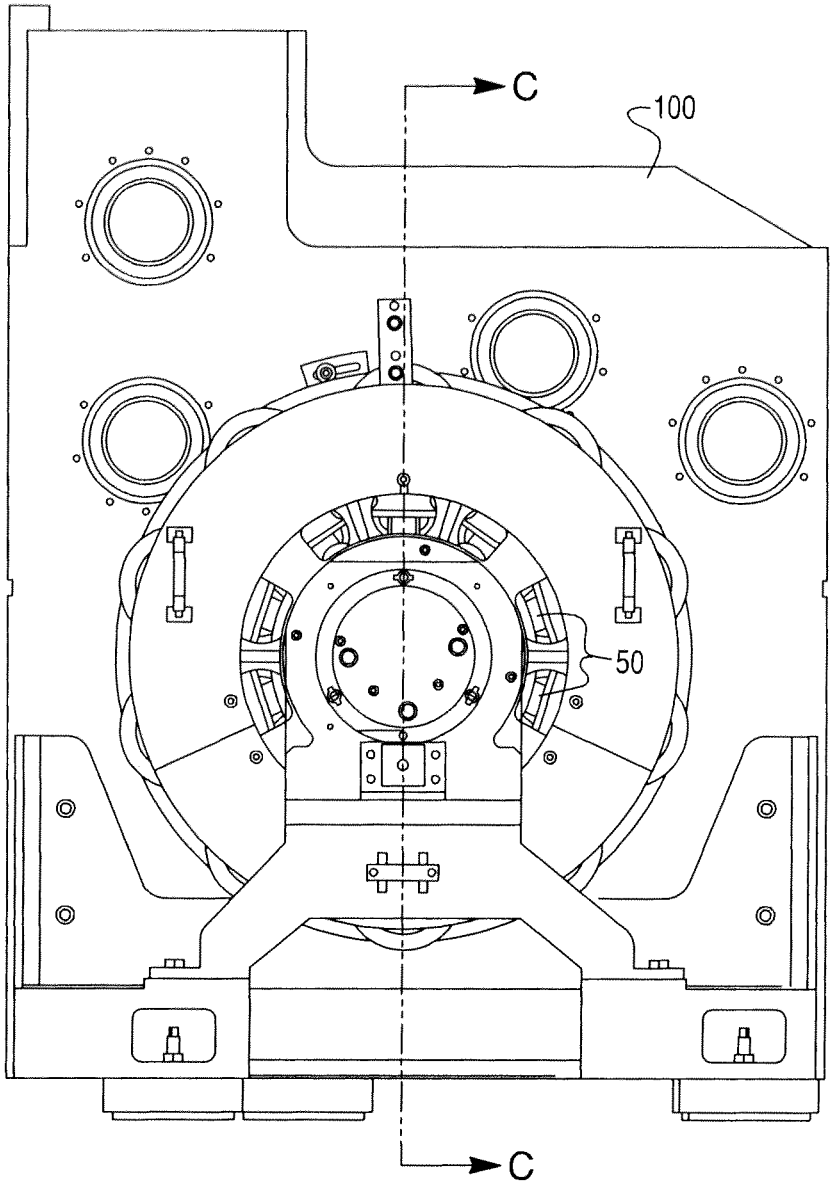
FIG. 10 is a front plan view of the threading turret of FIG. 9.

After the threads 20 are formed on the can 10, the threading head 50 opens (i.e., the threading rollers 52, 54 are retracted away from each other) and the can 10 is retracted from the head 50 by the sliding ram 124 and push plate assembly 120 (FIG. 9). The can 10 is then transferred to the next operation by a vacuum transfer star wheel 122.

Figure 13:
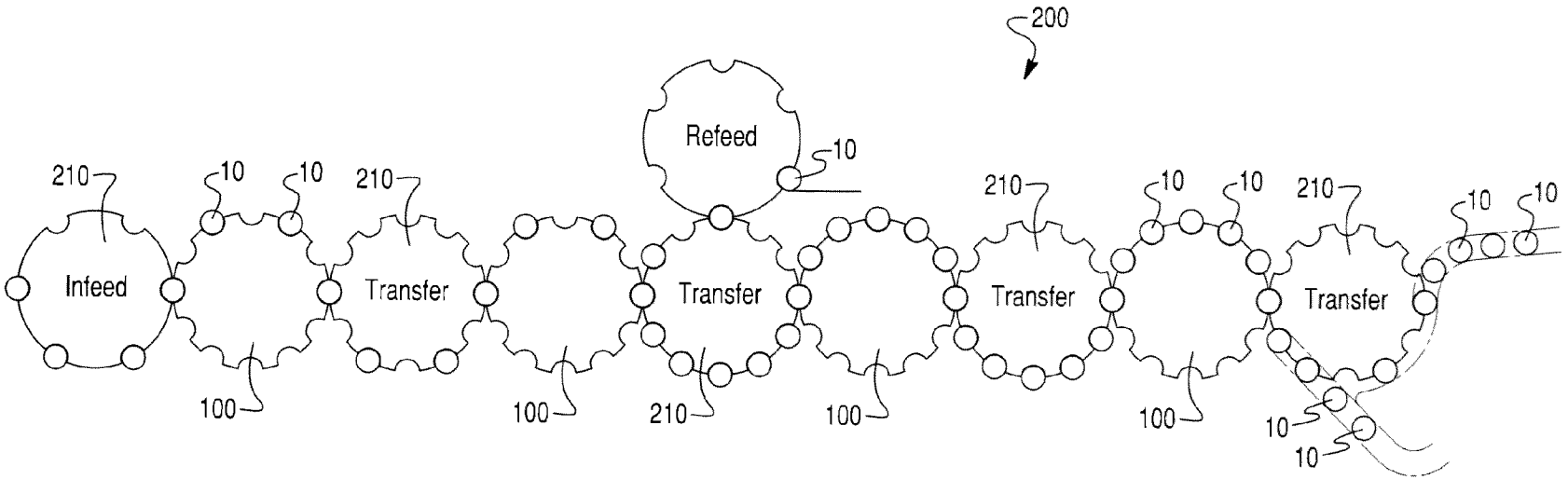
FIG. 13 is a schematic of a machine line according to an embodiment.

Cans 10, according to an embodiment shown in FIG. 13, are fed into a continuously rotating turret 100 either from an infeed track or from a preceding transfer turret 210, which may be part of a machine line 200. The star wheels 122 are arranged to hold the cans 10 in position using suction. The star wheels 122 may have a vacuum port formed in a channel portion(s) that are fluidly communicating with a source of vacuum (negative pneumatic pressure) via a suitable manifold. The vacuum is delivered to the vacuum ports, and the surface area of the cans 10, which are exposed to the suction. The vacuum is increased to a degree that the cans 10 are stably held in position as each can 10 passes below the transfer star wheel axis of rotation.

It will be recognized that the turret 100 may contain any number of threader heads 50. For example, the turret 100 may include one, two, ten, or any other suitable number of threader heads 50.

It is further noted that some embodiments of the embodiment include methods of threading a bottle that would result from utilizing the devices describe herein.

In another embodiment of the invention, the threading head 50 may used in conjunction with a recirculation device of a machine arrangement, such as described in U.S. Provisional Application No. 60/787,502, filed Mar. 31, 2006, and related non-provisional application of Jim Marshall, et al. that is titled: METHOD AND APPARATUS FOR BOTTLE RECIRCULATION filed on the same day as the present application, both applications are incorporated by reference herein in their entirety. The machine arrangement includes a recirculation mechanism (device) and a plurality of turrets that operate on a plurality of cans 10. At least one of the turrets comprises an apparatus configured to modify the cans 10 in at least one modifying operation, such as a threading operation on a threading turret 100, as the cans 10 pass from an article infeed to an article discharge of the machine arrangement. The recirculation mechanism moves cans 10 from a downstream machine after a first pass and recirculates the cans 10 back to an upstream machine in a recirculation (second) pass so that the cans 10, which are recirculated through the recirculation pass, are again subjected to the at least one modifying operation (or a variant thereof) in a turret that the cans 10 have previously passed through in the first pass. In the first pass, the cans 10 are positioned in a first set of alternating pockets in a star wheel (i.e, first, third, fifth, etc.). In the recirculation pass, the cans 10 are positioned in a second set of alternating pockets in the star wheel (i.e., second, fourth, sixth, etc.). Each turret 100 may include a threading head 50 to correspond to each pocket on a star wheel. Alternatively, a turret 100 may only include a threading head 50 to correspond to alternating pockets. In an embodiment, when the can 10 is recirculated to a different (alternating) set of pockets, the threading heads 50 may have a different diameter, thread depth, or other differences to correspond to the state of the can 10 after having undergone modifying operations in the first pass. Thus, threading heads 50 that operate on cans 10 in the recirculation pass are modified to further thread a can 10 after the can 10 has undergone other modifying operations.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A method of preparing a stress induced plastically deformed container for use as a threaded sealable container, comprising:

moving a plastically deformable container relative to a first threading roller and a second threading roller, the container including a curved wall defining an open end;

positioning the first threading roller inside an open end of the container and positioning the second threading roller outside the open end of the container;

moving the first threading roller and the second threading roller relative to each other into contact with opposite sides of the curved wall defining the open end, wherein the first threading roller is associated with a first cam roller and is moved by moving the first cam roller along a first cam and the second threading roller is associated with a second cam roller and is moved by moving the second cam roller along a second cam, the first cam roller being separate from the second cam roller, the second cam being separate from the first cam; and automatically orbiting the two threading roller about the container to impart a helical thread onto the curved wall.

2. The method of claim 1, further comprising rotating the two first and second threading rollers in opposite directions relative to one another and moving the first and second threading rollers along the curved wall to impart the helical thread onto the curved wall.

3. The method of claim 2, further comprising rotating one of the first and second threading rollers once for every two rotations of the other of the first and second threading rollers.

4. The method of claim 1, further comprising moving one or both of the first and second threading rollers towards each other to clamp onto the curved wall.

5. The method of claim 1, further comprising plastically deforming the container with the first and second threading rollers as the first and second threading rollers are orbited about the container so as to impart the helical thread onto the curved wall.

6. The method of claim 1, wherein the first and second threading rollers include threads, the method further comprising meshing the threads with each other when the curved wall is in between the first and second threading rollers.

7. The method of claim 1, further comprising automatically applying a gripping force to hold the container and react against force imparted onto the container from the first and second threading rollers.

8. The method of claim 1, comprising:

automatically placing a curved wall of a plastically deformable container in between the first and second threading rollers; and automatically moving the container from between the first and second threading rollers after the curved wall has been threaded.

9. The method of claim 1, wherein the first and second threading rollers are mounted on a turret, the method further comprising: automatically orbiting the turret about a gear to impart the orbit of the first and second threading rollers about the container.

10. The method of claim 1, wherein the two first and second threading rollers are mounted on a threading head, the method further comprising:

automatically orbiting the threading head about a gear to impart the orbit of the first and second threading rollers about the container; and rotating the gear to vary the speed at which two first and second threading rollers orbit about the container.

11. A method of preparing a stress induced plastically deformed container for use as a threaded sealable container, comprising:

moving a plastically deformable container relative to a first threading roller and a second threading roller, the container including a curved wall defining an open end;

positioning the first threading roller inside an open end of the container and positioning the second threading roller outside the open end of the container;

moving the first threading roller and the second threading roller relative to each other into contact with opposite sides of the curved wall defining the open end, wherein the first threading roller is associated with a first cam roller and is moved by moving the first cam roller along a first cam and the second threading roller is associated with a second cam roller and is moved by moving the second cam roller along a second cam, the first cam roller being separate from the second cam roller, the second cam being separate from the first cam; and automatically orbiting the two threading roller about the container to impart a helical thread onto the curved wall, wherein the step of moving the first threading roller and the second threading roller relative to each other into contact with opposite sides of the curved wall further includes moving a first support assembly, linked to the first cam roller that interfaces with the first cam, and a second support assembly, linked to the cam roller that interfaces with the second cam.

12. The method of claim 11, further comprising moving the first and second threading rollers away from each other when the first and second support assemblies move away from each other.

* * * * *

UNITED STATES PATENT AND TRADEMARK OFFICE

CERTIFICATE OF CORRECTION

PATENT NO. : 8,505,350 B2
APPLICATION NO. : 13/024830
DATED : August 13, 2013
INVENTOR(S) : Marshall et al.

It is certified that error appears in the above-identified patent and that said Letters Patent is hereby corrected as shown below:

In the Claims

In column 9, line 59 (claim 1, line 15), after cam, please insert -- , --.

In column 9, line 67 (claim 2, line 2), please delete “two”.

In column 10, line 35 (claim 10, line 1), please delete “two”.

In column 10, line 42 (claim 10, line 7), please delete “two” and insert -- the --, therefor.

In column 10, line 57 (claim 11, line 15), after cam, please insert -- , --.

Signed and Sealed this
Eleventh Day of February, 2014

Michelle K. Lee

Michelle K. Lee
*Deputy Director of the United States Patent and Trademark Office*